US008074587B2

(12) United States Patent
Olson

(10) Patent No.: US 8,074,587 B2
(45) Date of Patent: Dec. 13, 2011

(54) QUILTING TOOL

(76) Inventor: Carol E. Olson, Usk, WA (US)

( * ) Notice: Subject to any disclaimer, the term of this patent is extended or adjusted under 35 U.S.C. 154(b) by 183 days.

(21) Appl. No.: 12/589,306

(22) Filed: Oct. 22, 2009

(65) Prior Publication Data

US 2011/0094425 A1 Apr. 28, 2011

(51) Int. Cl.
*D05B 11/00* (2006.01)

(52) U.S. Cl. ..... 112/117

(58) Field of Classification Search ..... 112/117, 112/118, 119, 311; 24/67.5, 67.9, 507, 508, 24/545, 556, 553; 33/483, 484, 489, 490, 33/492, 493

See application file for complete search history.

(56) References Cited

U.S. PATENT DOCUMENTS 566,195 A * 8/1896 Leavitt ..... 33/485
743,119 A * 11/1903 Watson ..... 34/89.2
4,987,812 A * 1/1991 Benavidez ..... 83/455
5,027,727 A * 7/1991 Ulmer ..... 112/153
6,349,479 B1 * 2/2002 Bottega ..... 33/481
6,446,567 B2 * 9/2002 Hindsley ..... 112/117
6,860,211 B2 * 3/2005 Valeriote et al. ..... 112/117
7,043,850 B2 * 5/2006 Brady ..... 33/562
7,490,412 B1 * 2/2009 Gupta ..... 33/492
D616,317 S * 5/2010 Yeh ..... D10/71

* cited by examiner

*Primary Examiner* — Tejash Patel

(57) ABSTRACT

A quilting tool for use with commercial quilting machines with a base, a pair of handles and a narrow strip of the hook portion of hook and loop type fastener. The base is planar and rectilinear and has a plurality of spaced apart grooves that are defined on the bottom surface. The first grooves on each long edge of the base are spaced one quarter of an inch from the long edge. The second grooves from each edge are spaced one half of an inch from the first grooves. The two medial grooves are spaced apart one inch. The handles are dowel-like and extend upwardly from the top of the base and are spaced apart from each other by approximately two and three quarter inches. The hook strip portion adhesively attached between the grooves on the underside of the base and aligned to be directly under the handles.

5 Claims, 8 Drawing Sheets

QUILTING TOOL

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of sewing accessories and more specifically to a quilting tool to be used in conjunction with a commercial long arm quilting machine.

The art of quilting has been in existence for over one hundred years. The quilting process generally involves combining a top layer of fabric, that in some instances is created by sewing numerous separate pieces of fabric together, and combining the top layer with an intermediate layer of batting material and a bottom layer of fabric. The process is quite different than using a standard sewing machine because a commercial long arm quilting machine sits on a carriage that has wheels which run along a track. The quilt is loaded on to a frame system for quilting. Generally, when using a quilting machine, the user is in a standing position. The machine is strictly designed for applying a design in thread on the quilt top and not for sewing seams together as when using a conventional sewing machine. Many times, a quilter will want to stitch a series of parallel lines either in a horizontal direction or in a diagonal direction. The quilter usually desires that these lines be parallel to each other. It can be difficult to maintain the parallel nature of the quilt lines and also difficult to measure in a repeated fashion the distance between quilt lines. Therefore a quilting tool that helps facilitate this operation would be beneficial.

There have been a number patents issued for ruler type devices that help operators of standard sewing machines to measure the distance between sewn lines, including John Brady's U.S. Pat. No. 7,043,850 and Christian Ulmer's U.S. Pat. No. 5,027,727. However these devices do not take into account the unique conditions present when using a commercial grade quilting machine.

One ruler type device invented by Lisa Kidd, Pat. No. Des. 374,404 shows a transparent ruler to be used for quilting. However, since it is a design patent, it does not discuss unique utilitarian features. Even so, it has deficiencies in that it does not have an easy way to hold and move the device with one hand, and it does not have a way to keep the ruler from sliding during use.

BRIEF SUMMARY OF THE INVENTION

The primary object of the invention is to provide a quilting tool that easily measures distances between stitched lines when using a commercial grade long arm quilting machine and helps maintain a parallel condition from one stitched line to another.

Another object of the invention is to provide a quilting tool that allows a person to easily hold the tool with one hand to facilitate horizontal stitching or diagonal stitching.

Another object of the invention is to provide a quilting tool that grips the fabric being sewn to insure a straight line design with no sliding of the tool.

A further object of the invention is to provide a tool that allows the user to easily measure ¼", ½", 1", 2", and 2.5" widths between lines design while sewing.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a quilting tool comprising: a base, a pair of handles, a narrow strip of the hook portion of hook and loop type fastener, said base being planar and rectilinear, said base having a bottom and a top, said base having elongate end portions that are parallel and spaced apart from one another, said base having elongate edges likewise parallel and spaced apart from one another, said base formed from transparent thermal plastic, said base including plural spaced apart grooves that are defined on the bottom surface extending from the first elongate end portion to the opposing second elongate end portion, a first said groove spaced one quarter of an inch from the opposing elongate edge, a second said groove spaced one half of an inch from said first groove and spaced three quarters of an inch from the proximate elongate edge, said two medial grooves spaced apart one inch, said handles being dowel-like and extending upwardly from the top of said base, said handles being centrally located and fixedly attached to said base and being spaced apart from each other by approximately two and three quarter inches, said handles each being approximately three eighths of an inch in diameter and one and one quarter of an inch tall, and said hook strip portion adhesively attached between said grooves on the underside of said base and aligned to be directly under said handles.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
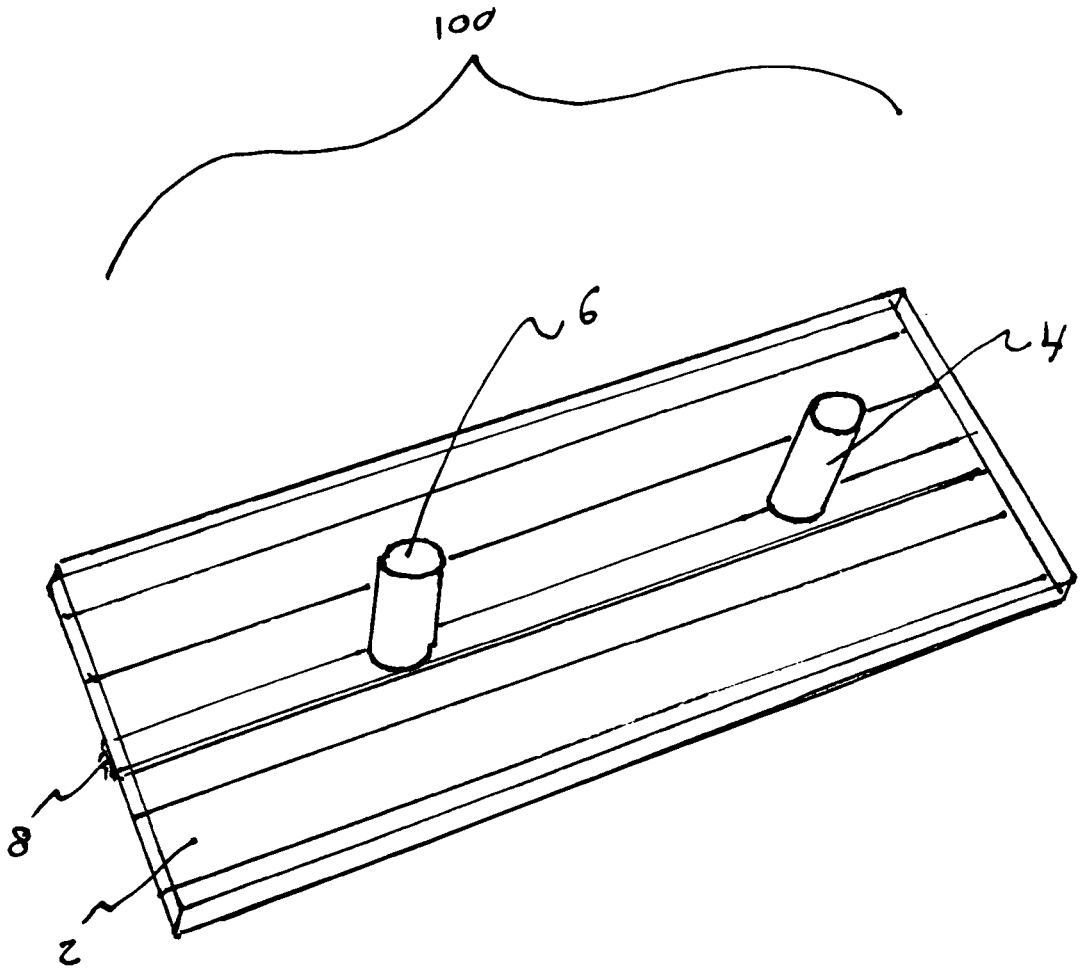
FIG. 1 is a perspective view of the invention.

Referring now to FIG. 1 we see a perspective view of the present quilting tool device 100. The device includes a flat rectangular base plate 2 formed from transparent thermal plastic such as acrylic and a pair of dowel-like handles 4, 6 that are centrally and fixedly attached to the base plate 2 and extend upwardly from the top of the base 2. A narrow strip 8 of the hook portion of standard hook and loop type fastening material is adhered to the underside of the transparent plate 2. A plurality of spaced apart micro grooves are laser cut into the bottom of the plate 2, as will be discussed below and act as guide lines for the operator of a commercial quilting machine when stitching a plurality of parallel lines in a quilt. The base 2 is planar and rectilinear. The base 2 has a bottom and a top and has elongate end portions that are spaced parallel and spaced apart from one another.

Figure 2:
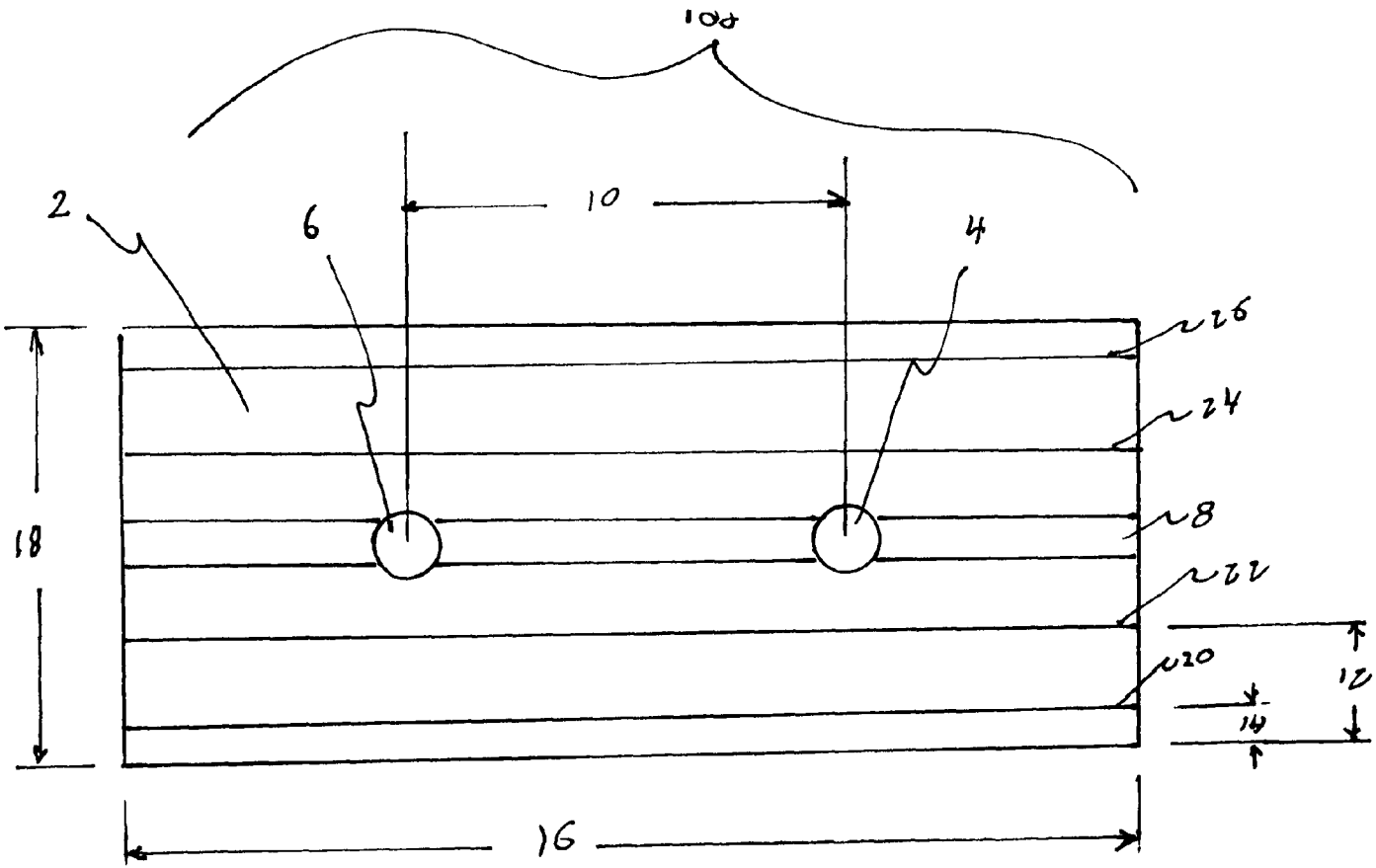
FIG. 2 is a top plan view of the invention.

FIG. 2 shows a top plan view of the invention 100. Guide lines 20, 22, 24, 26 laser cut into the bottom of the base 2 and show through the transparency of the base 2. A first groove 20 is one quarter of an inch from the front edge as shown by dimension line 14. A second groove is spaced one half of an inch from the first groove or three quarters of an inch from the front edge as shown by dimension arrows 12. Grooves 26 and 24 are spaced in a similar way from the far edge of the plate 2. The distance between the two medial grooves is one inch. The combination of distances between grooves gives the user many choices of spacing between stitch lines during use. The quilting tool's 100 incremental scoring is the same on either side of the base plate which makes it universal for left-handed or right-handed persons. The line increments being identical on either side also keeps the line widths consistent no matter what position the tool 100 is being utilized, whether horizontal, vertical or diagonal. Depending on upon the distance the user wants the second stitch line to be made from the first stitch line, the user selects the appropriate groove and places that groove over the first stitch line. Handles 4, 6 are approximately three eights of an inch in diameter and approximately a distance of two and three quarters of an inch apart center to center as shown by dimension line 10. The base plate 2 is approximately two and one half inches wide as shown by dimension line 18 and six inches long as shown by dimension line 16.

Figure 3:
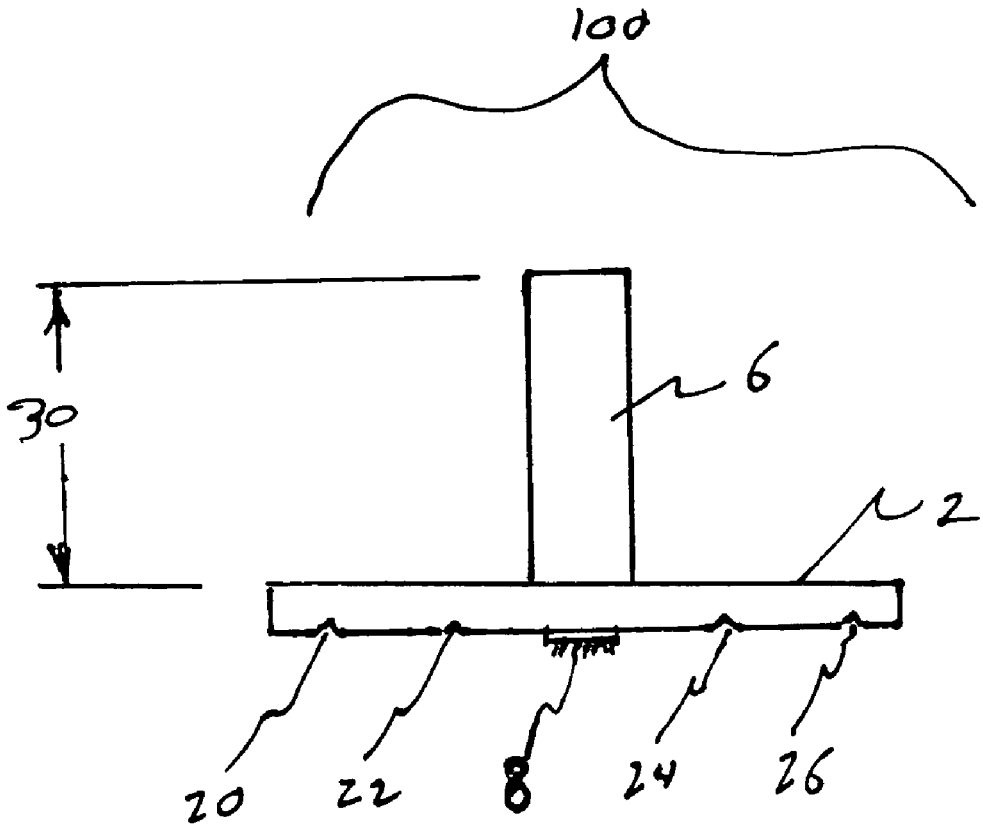
FIG. 3 is a side view of the invention.

FIG. 3 is a side view of the invention 100. The micro laser cut V grooves 20. 22. 24. 26 can be clearly seen. These grooves are far superior to other transparent measuring tools that normally have guide lines printed onto the underside of the device. The printed lines can wear off after repeated use, making the device unusable. Also shown in FIG. 3 is the end view of the hook type strip 8. This strip helps keep the quilting tool 100 from slipping on the top layer of fabric being quilted thereby requiring less downward hand pressure during use reducing muscle fatigue in the wrist and forearm. The height of the handles 6, 4 is approximately one and one quarter of an inch tall as indicated by dimension line 30.

Figure 4:
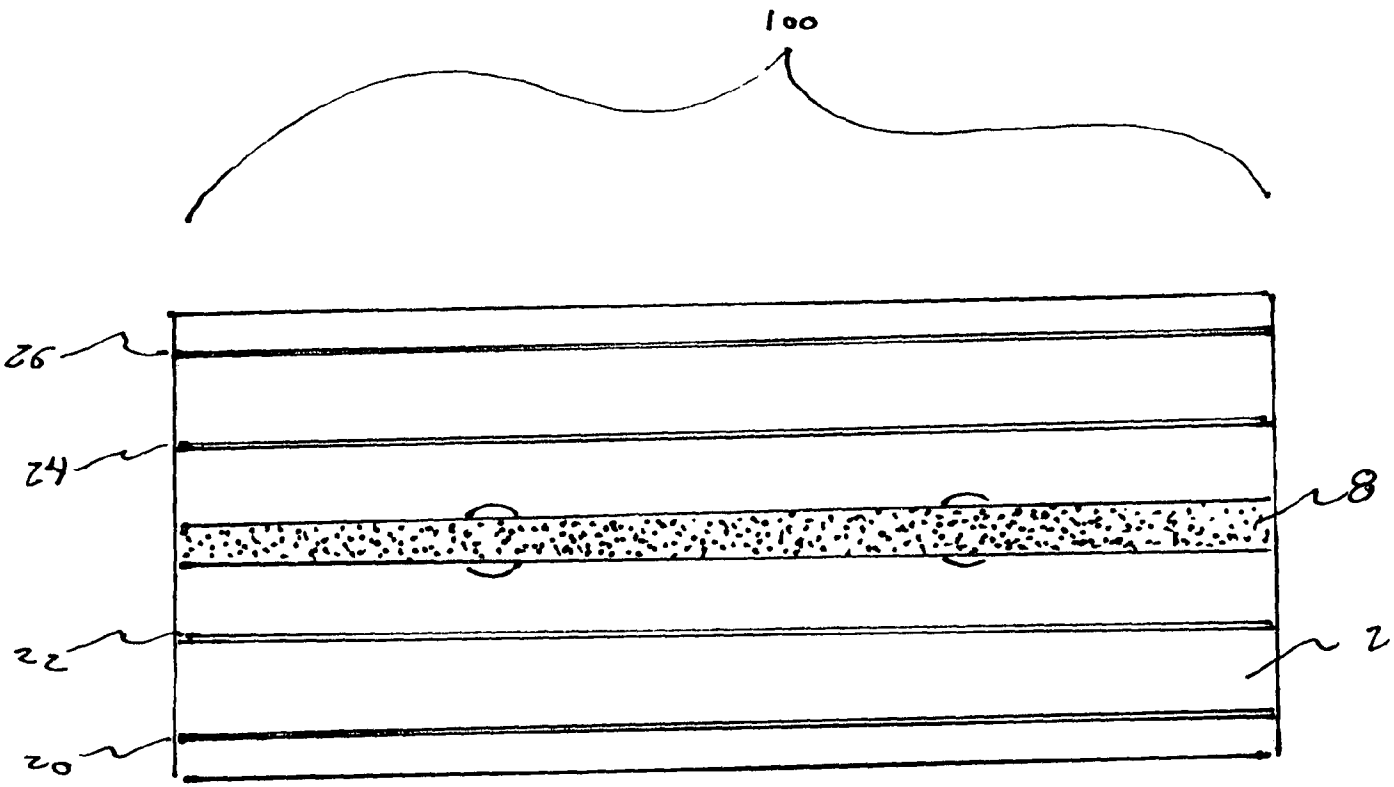
FIG. 4 is a bottom plan view of the invention.

FIG. 4 is a bottom view of the invention 100. Laser cut grooves 20, 22, 24, 26 are clearly seen as is hook fastener strip 8.

Figure 5:
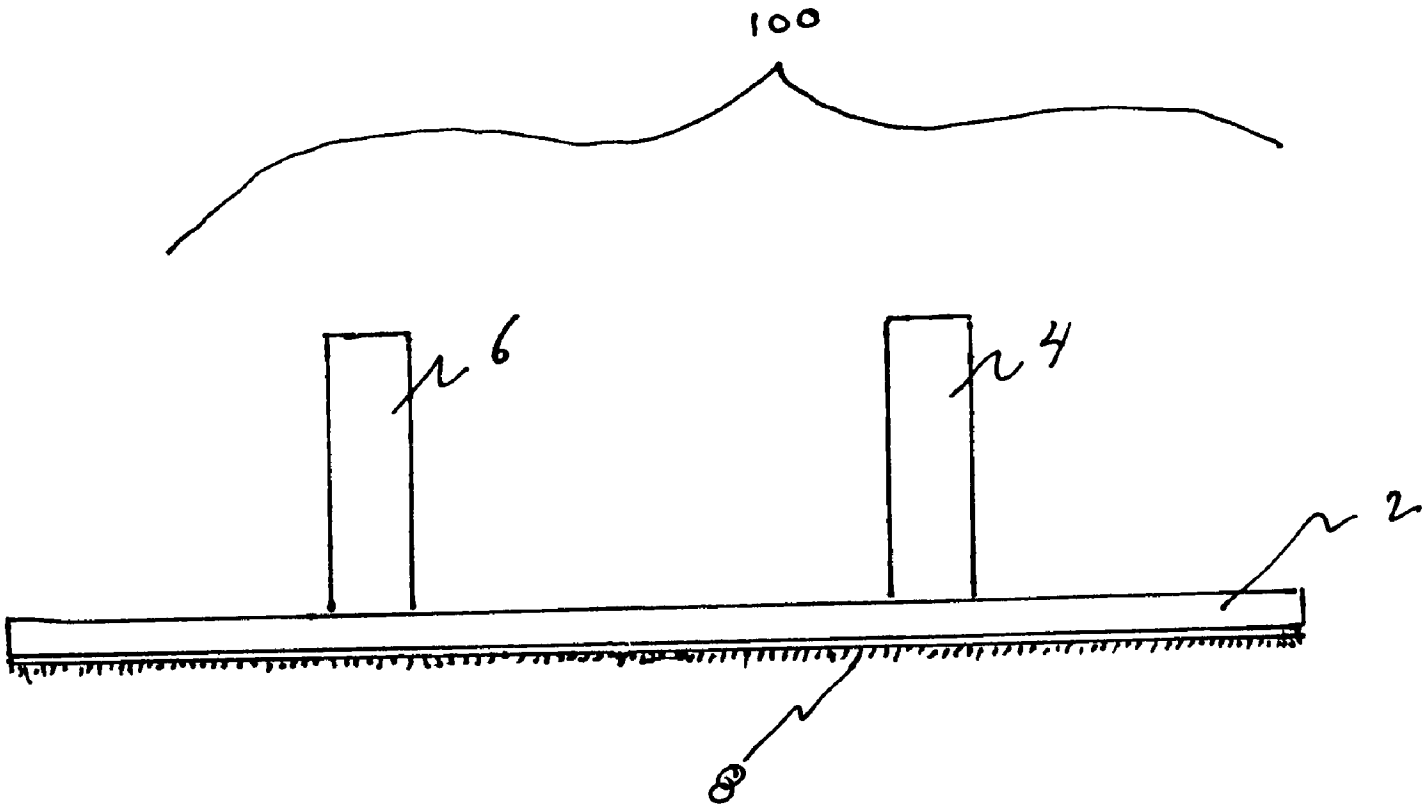
FIG. 5 is a front view of the invention.

FIG. 5 is a front view of the invention.

Figure 6:
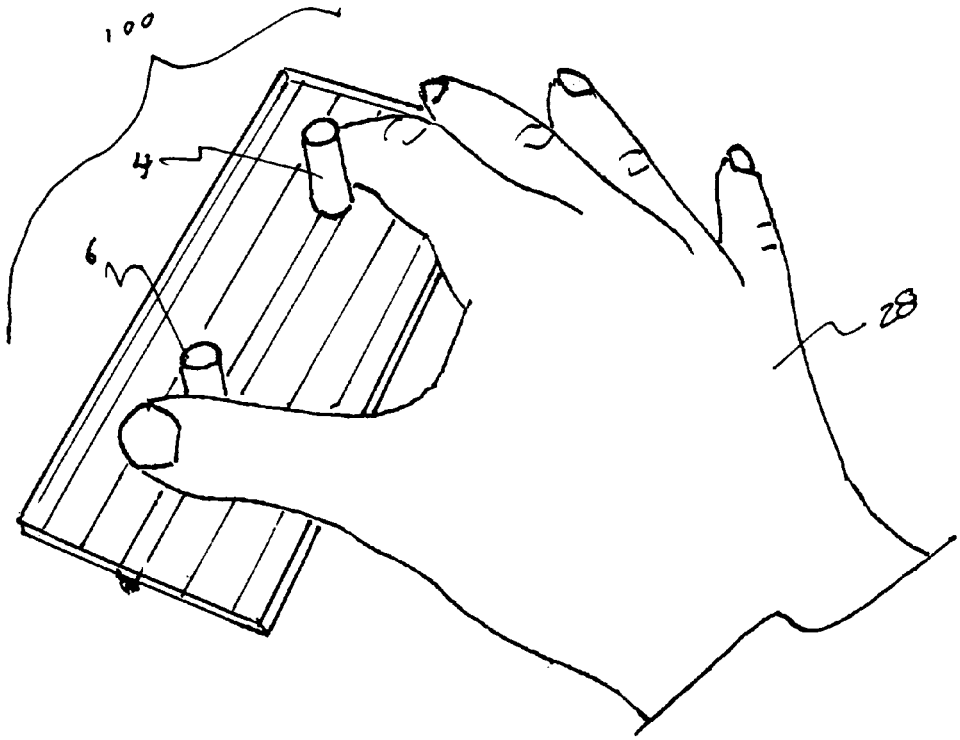
FIG. 6 is a perspective view of the invention in use in the diagonal mode.

FIG. 6 shows one method of holding the quilting tool 100 during use. This position works best for making diagonal stitch lines. In this application the user 28 places his or her thumb to one side of handle 6 and places his or her forefinger to the outward side of handle 4. This gripping method produces the least amount of strain on the user's arm and shoulder while making diagonal stitches.

Figure 7:
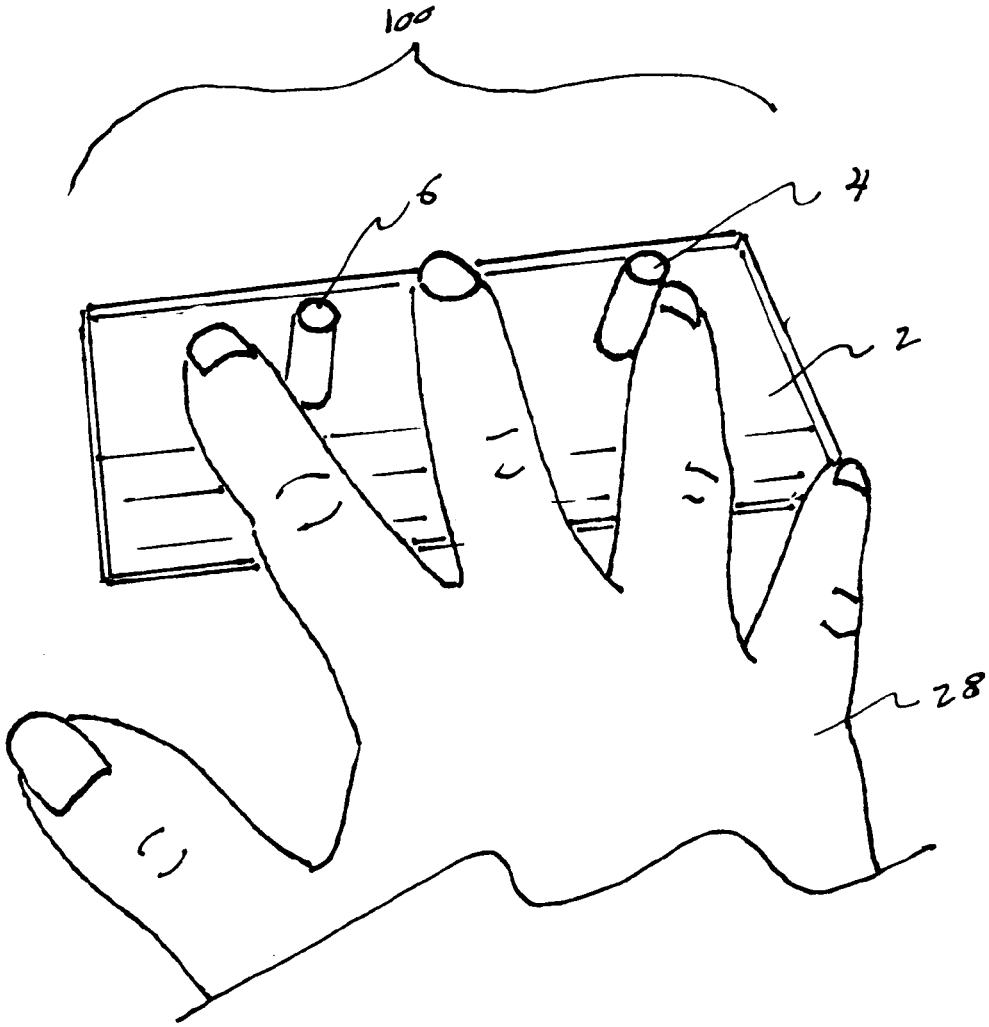
FIG. 7 is a perspective view of the invention in use in the horizontal mode.

FIG. 7 shows a second method of holding the quilting tool during use. This position works best for making horizontal stitch lines. In this application the user 28 places his or her fore finger on the outside of handle 6 and his or her ring finger on the outside of handle 4. This gripping method produces the least amount of strain on the user's arm and shoulder while making horizontal stitches. The distance between handle 4 and handle 6 is critical for proper operation and maximum control of the device 100.

Figure 8:
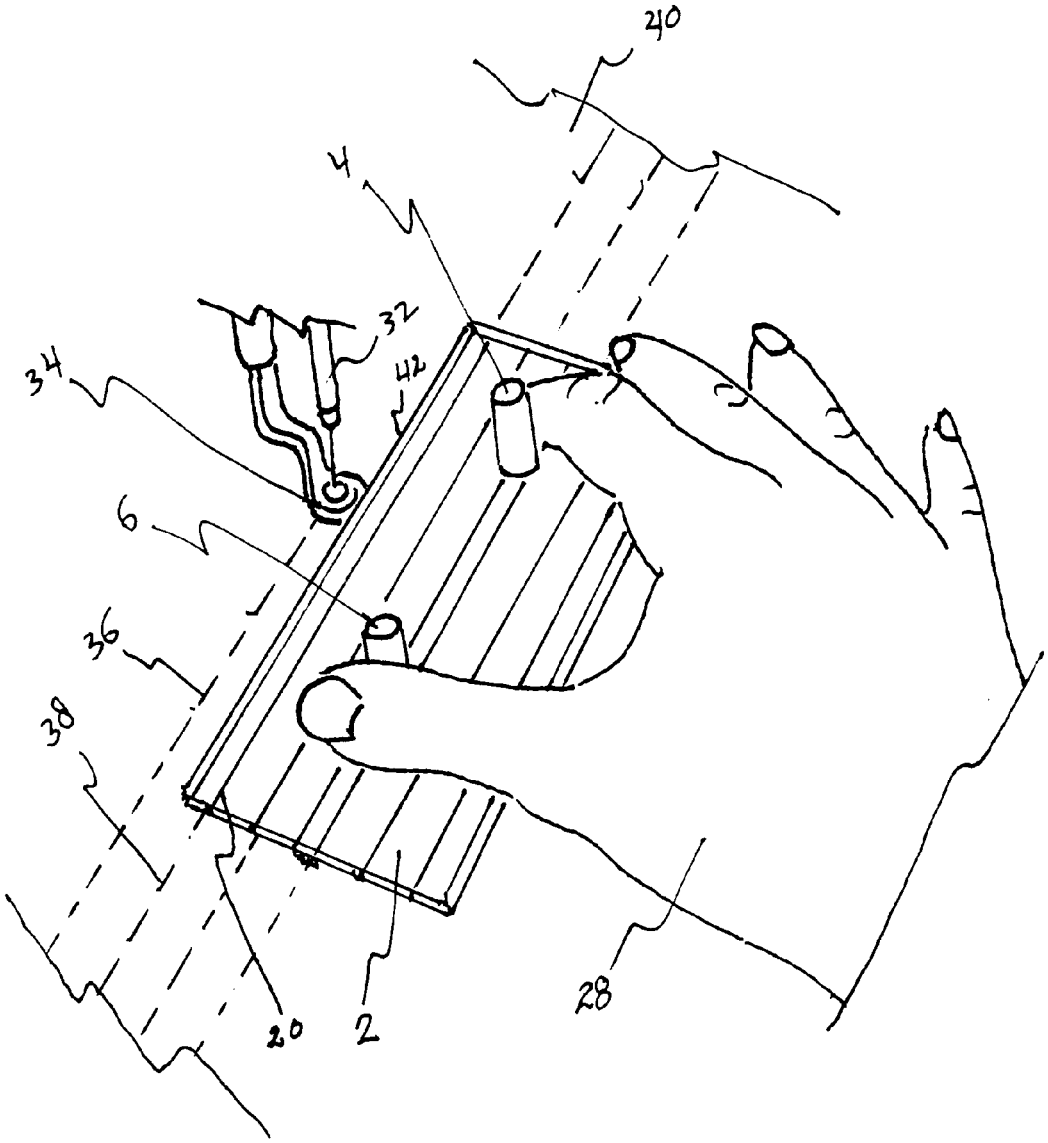
FIG. 8 is a perspective view of the invention in use showing stitch lines.

FIG. 8 shows a perspective view of the invention in use. The user 28 maintains frictional contact between base edge 42 and the periphery of the circular quilting foot 34 as stitching needle 32 makes stitch lines 36 in the fabric quilt top 40. In this case the user 28 has placed groove line 20 on previously stitched line 36 which acts as a guide for the desired parallel spacing of new stitch line 36. In this way, a person may use the present novel invention to produce consistently spaced and parallel stitch lines on a quilt top while in the process of using a long arm quilting machine.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A quilting tool comprising:

a rigid base plate member constructed of transparent molded plastic having opposed top and bottom surfaces;

a pair of handle members centrally and fixedly attached in a vertical orientation with respect to the top surface of said rigid base plate member that are spaced from each other by approximately two and three quarters inches;

a hook fastener strip member;

said rigid base plate member being planar and rectilinear in shape;

the bottom surface of said base plate member includes first and second pair of spaced apart grooves with each of the first pair of spaced apart grooves being spaced one quarter of an inch from opposing elongate edges respectively and each of the second pair of spaced apart grooves separated apart by one inch therebetween and spaced one half of an inch from each of the first pair of spaced apart grooves such that each of the second spaced apart grooves is spaced three quarters of an inch from the opposing edges;

said hook fastener strip member is centrally attached to the bottom surface of said rigid base plate member by adhesive in a parallel orientation to said pair of handle members.

2. The quilting tool as claimed in claim 1 wherein said rigid base plate member is approximately two and one half inches wide and six inches long.

3. The quilting tool as claimed in claim 1 wherein said first and second pair of spaced apart grooves are laser scored.

4. The quilting tool as claimed in claim 1 wherein said rigid base plate member is substantially eight inches long.

5. The quilting tool as claimed in claim 1 wherein said rigid plate member is substantially twelve inches long.

* * * * *